US008147955B2

(12) United States Patent
Deib

(10) Patent No.: US 8,147,955 B2
(45) Date of Patent: Apr. 3, 2012

(54) SEALING BAND MADE OF SOFT FOAMED MATERIAL

(75) Inventor: Martin Deib, Abtsgmund (DE)

(73) Assignee: ISO-Chemie GmbH (DE)

( * ) Notice: Subject to any disclaimer, the term of this patent is extended or adjusted under 35 U.S.C. 154(b) by 362 days.

(21) Appl. No.: 12/102,043

(22) Filed: Apr. 14, 2008

(65) Prior Publication Data

US 2008/0268231 A1 Oct. 30, 2008

(30) Foreign Application Priority Data

Apr. 18, 2007 (EP) ..... 07007916

(51) Int. Cl.
*B32B 7/12* (2006.01)
*B05D 5/10* (2006.01)

(52) U.S. Cl. ..... 428/343; 428/352; 428/306.6; 428/308.4; 428/192; 427/299; 427/322

(58) Field of Classification Search ..... 428/343, 428/352, 306.6, 308.4, 192; 427/299, 322
See application file for complete search history.

(56) References Cited

U.S. PATENT DOCUMENTS

| | | | | |
|---|---|---|---|---|
| 4,181,711 | A | 1/1980 | Asakura et al. | |
| 4,736,558 | A | 4/1988 | Taraba | |
| 5,567,514 | A * | 10/1996 | Gold | 428/350 |
| 7,517,585 | B1 * | 4/2009 | Funderburk et al. | 428/354 |
| 2002/0150738 | A1 * | 10/2002 | Bouic | 428/195 |

FOREIGN PATENT DOCUMENTS

AU 663 480 10/1995

* cited by examiner

*Primary Examiner* — Hai Vo
(74) *Attorney, Agent, or Firm* — Jansson Shupe & Munger Ltd.

(57) ABSTRACT

The joint-sealing tape of flexible foam capable of recovering its shape after compression with two lateral surfaces (3, 4) is colored on at least one of the two lateral surfaces (3, 4) with a colorant in such a way that, in a partially expanded functional state of the sealing tape, i.e., in a state of partial recovery after compression, the coloring on the lateral surface (3, 4), when viewed from the side, appears to the human eye as a continuous colored surface.

14 Claims, 3 Drawing Sheets

SEALING BAND MADE OF SOFT FOAMED MATERIAL

CROSS REFERENCE TO RELATED APPLICATION

This application claims priority to European patent application EP 07 007 916.5, filed Apr. 18, 2007.

FIELD OF THE INVENTION

The present invention relates to the field of rolls of tape of flexible foam used for sealing joints especially in the construction industry.

BACKGROUND OF THE INVENTION

These types of joint-sealing tapes usually consist of polyethylene or polyurethane foam. The spectrum of flexible foams extends from closed-cell foams, which allow virtually no air to pass through, to open-cell foams, which have relatively high air permeability. At least the open-cell foams are usually saturated with an impregnate to achieve the desired sealing properties. Such impregnates also lead to a delayed recovery of the foam after its compression, because the impregnates usually contain adhesive substances, which settle on the cell webs of the foam structure and adhere there. Use is often made of the delayed recovery effect when joints are to be sealed, in that the foam is first compressed and inserted into the joint to be sealed, whereupon the foam partially re-expands to assume its functional state and seals the joint. Usually, such joint-sealing tapes are sold wound up to rolls.

Pasty and injectable sealing compounds of polyurethane, silicone, or acrylate, which are available on the market in many colors, are also used for sealing. Such sealing compounds are hardly usable in expansion joints, however, because they stick to the sides of the joint and can tear if the expansion is too great.

Joint-sealing tapes in the exterior area of buildings are frequently being left uncovered after installation nowadays and are thus being left exposed to the weather, and in some cases they are even visible to observers on the outside.

It is therefore an object of the present invention to create a roll of joint-sealing tape of flexible foam capable of recovering its shape after compression which is also suitable for use in uncovered exterior joints and which creates a superior overall aesthetic impression.

SUMMARY OF THE INVENTION

This invention is a roll of joint-sealing tape of flexible foam which recovers its original shape after compression, and is useful for sealing joints, especially in the construction industry.

The inventive roll is a joint-sealing tape of flexible foam capable of recovery after compression has two lateral surfaces, where at least one of the two lateral surfaces is colored with a colorant in such a way that the coloration on the lateral surface in a partially expanded functional state equivalent to 15-80% of the original thickness of the sealing tape appears to the human eye as a continuous colored surface, whereas no coloration is provided in the central area between the lateral surfaces. The edge area of at least one of the two lateral surfaces of the joint-sealing tape is uniformly colored with the colorant to a depth of up to a few millimeters by means of dipping, spraying, or spreading.

As a result, the range of applications in the construction field for joint-sealing tapes of flexible foam for the sealing of joints visible to the observer is considerably expanded, and, in addition to the sealing function of the sealing tape, an aesthetic design option, which requires only a small amount of colorant, is also created. No negative effects are caused on the desired basic properties of the foam, nor is there any change in color within the sealing tape or between different lots of sealing tape.

The joint-sealing tape preferably consists of a foam with the properties of delayed recovery after compression, which makes it easier to install the tape in the joint. The delayed recovery is usually achieved by impregnating the foam, but now there are also foams which show delayed recovery without impregnation.

In a microscopic view from the side, the sealing tape advantageously shows a plurality of different-sized color specks, where the average area of a color speck in the partially expanded functional state of the sealing tape is in the range of 0.0001-0.5 $mm^2$, and preferably in the range of 0.0025-0.3 $mm^2$. This range has been found to be especially favorable in terms of giving the human eye the impression of a continuous colored surface.

In this connection it is advantageous for the number of color flecks in the edge area of the lateral surface of the sealing tape to be large enough to ensure that, in the partially expanded functional state of the sealing tape, the color flecks together constitute at least 60% of the total visible area when the edge is viewed under a microscope from the side. When color specks of the above-cited dimensions are used, the observer will therefore obtain the impression of a continuous colored surface, because the resolving power of the human eye can no longer perceive the small gaps between the individual color specks.

For ease of handling, it is also preferable for the colorant to be formulated in such a way that, after compression, the sealing tape will be able to recover uniformly over its entire width.

So that optimal use can be made of the sealing properties of the joint-sealing tape, the partially expanded functional state of the sealing tape is preferably in the range of 25-60% of the maximum expansion of the sealing tape.

The inventive process for producing a partially compressed sealing tape of this type includes the following steps:

- providing a joint-sealing tape of flexible foam which has two lateral surfaces and which is capable of recovering its shape after compression;
- partially compressing the sealing tape; and
- coloring an edge area of up to a few millimeters deep with a colorant by dipping, spraying, or spreading, so that the coloration on the lateral surface in a partially expanded state of 15-80% of the original thickness of the sealing tape appears to the human eye as a continuous colored surface, whereas no coloration is provided in the central area between the two lateral surfaces.

So that the coloration process can be integrated seamlessly into the production process of the rolls of joint-sealing tape, the sealing tape is compressed to 10-60%, and preferably to 15-50%, of its original thickness before the coloration process. Ideally, this is done as the foam is being wound up into rolls of tape.

To ensure uniform recovery over the entire width of the sealing tape, the colorant contains, as a binder, either a paraffin-based wax, fat, or oil; a silane; or a silicone; or it contains an ethylene-vinyl acetate, a polyvinyl acetate, a polyurethane, or a silicate.

As the color medium, it is also possible to use solvents, preferably dipolar solvents. These dissolve the substrate slightly, and after evaporating they make it possible for the colorant to settle onto the substrate and to bond there.

So that the sealing tape can be provided with other functionalities besides its sealing properties, the colorant can also contain a fire retardant or a substance which protects against UV radiation.

DESCRIPTION OF THE DRAWINGS

Additional details, features, and properties of the present invention can be derived from the following detailed description, which refers to the attached drawings.

DETAILED DESCRIPTION OF A PREFERRED EMBODIMENT

The joint-sealing tape consists of a flexible foam which recovers its shape after compression. Polyethylene foam is a preferred material, but polyurethane foam is especially preferred. The foam can be an open-cell foam with very low resistance to the passage of air, or it can be an almost completely closed-cell foam with extremely low air permeability. Foams with permeabilities which are between the two extremes cited above can also be used within the scope of the invention. The foam can be saturated with an adhesive impregnate, which improves the sealing properties of the foam and which leads to a delayed recovery of the foam after it has been compressed.

Figure 1:
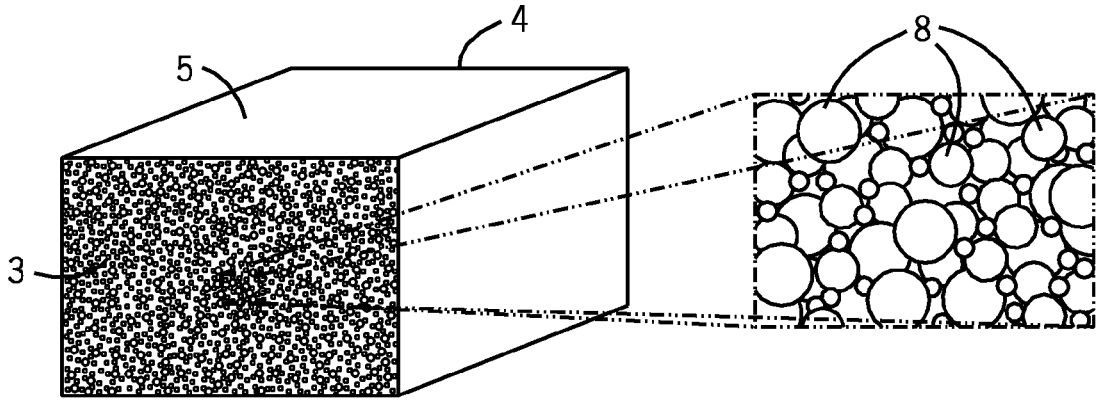
FIG. 1 is a perspective, schematic side view of a joint-sealing tape in a compressed state, where a section of the colored lateral surface is shown on a magnified scale.

FIG. 1 shows a perspective, schematic side view of a short piece of the joint-sealing tape made of this type of foam. A lateral surface 3 of the sealing tape is colored with a colorant of any desired color. It is also possible to color both lateral surfaces 3, 4 with the colorant. FIG. 1 also shows a microscopically enlarged section of the flat lateral surface 3 visible to the observer.

Figure 3:
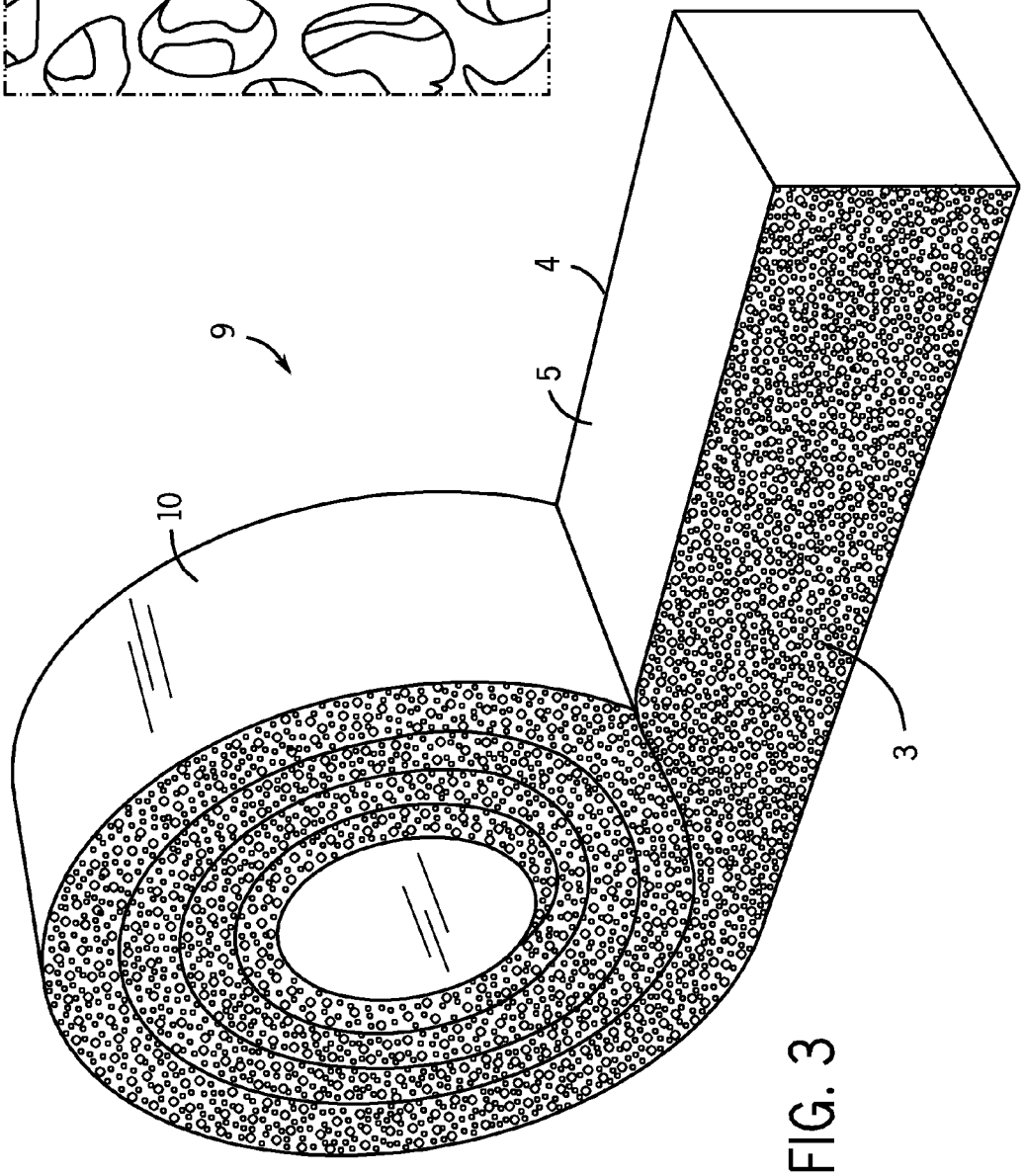
FIG. 3 is a perspective view of an inventive joint-sealing tape roll with the sealing tape of FIGS. 1 and 2.

The lateral surfaces 3, 4 extend in the longitudinal direction of the sealing tape, which is wound up into an inventive tape roll 9, and form its lateral boundaries, as shown in FIG. 3. The bottom surface of the sealing tape is usually covered with a peel-off strip 10 (see FIG. 3), under which there can be a layer of pressure-sensitive adhesive. Upon insertion into a joint, the two lateral surfaces 3, 4 extend transversely to the functional direction of the sealing tape, where at least one colored lateral surface 3, 4 remains visible to the observer.

The sealing tape of FIG. 1 is in the compressed state, which is also shown in FIG. 3. According to a preferred embodiment of the invention, the colorant is applied to at least one of the lateral surfaces 3, 4 of the compressed sealing tape by dipping, spraying, or spreading. "Application" in this context means preferably the saturation or wetting of an edge area of the lateral surface 3, 4 with the colorant to a penetration depth of up to several millimeters. In a central area 5 between the lateral surfaces 3, 4, preferably no coloring is provided for cost reasons and also to prevent any negative effect which the colorant might have on the overall behavior of the foam.

The microscopic enlargement in FIG. 1 shows color specks 8 of different sizes, which are represented in idealized fashion as circles or ovals. The color specks 8 often deviate from this ideal form, and agglomerates, clusters, and rows can also occur, as will be described in greater detail further below.

Figure 2:
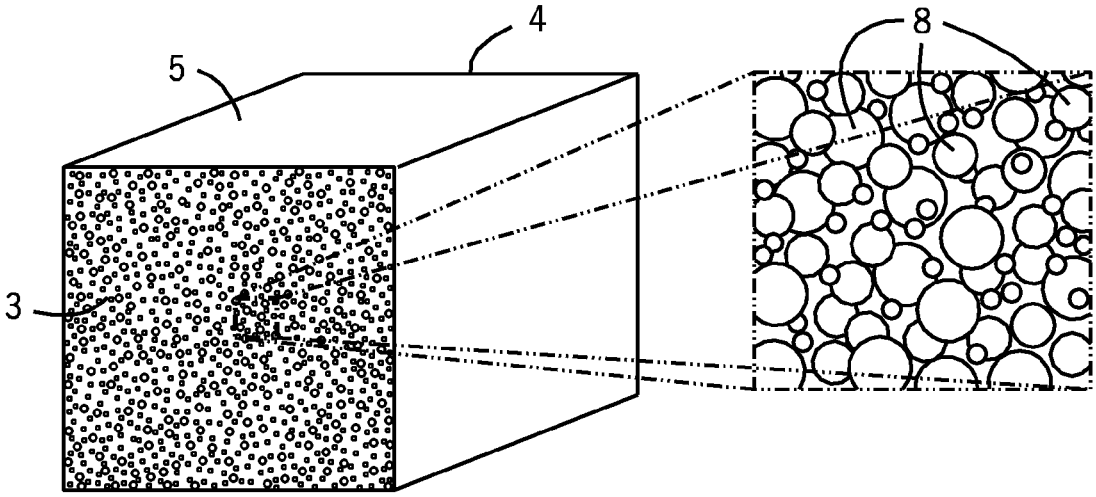
FIG. 2 is a perspective, schematic side view of the joint-sealing tape of FIG. 1 in a partially expanded functional state, where the same section of the colored lateral surface as that in FIG. 1 is again shown on a magnified scale.
Figure 4:
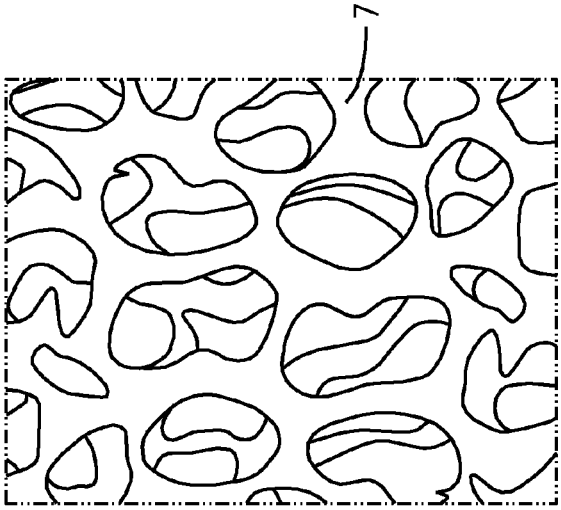
FIG. 4 is a schematic, enlarged cross-sectional view of a piece of foam, in which the cellular structure of the foam can be seen.

It should also be mentioned that the magnified views in FIGS. 1 and 2 are also schematic in the sense that the actual structure of the foam is not reproduced. In reality, the color specks 8 settle on the cell webs 7 or cell walls of the foam material and stick there as a result of the adhesiveness of the binder. A more realistic depiction of the cell structure of a foam can be seen in FIG. 4.

The color specks 8 can be formed by pigments or dyes. Dyes are already dissolved in a solvent or binder, whereas pigments are almost completely insoluble. They are in the form of particles in a mixture/formulation and are usually somewhat larger than dye particles. When pigments are used, a solvent or binder is also used in the invention to incorporate the pigment into the foam. To produce the coloration, preferably naturally occurring inorganic pigments, synthetically produced inorganic or organic pigments, or industrially produced dyes are used.

As additives, it is possible to use defoaming agents, hydrophobizing agents, wetting agents, drying agents, pigment distributors, fungicides, preservatives, and pH buffer solutions. A fire retardant such as an intumescing substance or an agent for protecting against UV radiation can also be added to the colorant. To support the colorizing effect, salts can also be added to the colorant. The colorant can be adjusted to either an acid or an alkaline pH.

During the coloration process, an edge area up to a few millimeters in depth is saturated or wetted with the colorant in such a way that the pigments or dyes settle on the cell webs 7 of the cellular structure as a result of the adhesive properties of the binder. The color specks 8 thus produced, as seen in the microscopic side view, usually have a lateral dimension of 0.01-0.7 mm, where a lateral dimension of a color speck 8 of 0.05 mm corresponds approximately to the limit of perception of the human eye. As a projection onto a flat surface, therefore, the color specks 8 have areas in the range of 0.0001-0.5 $mm^2$. In practice, the individual color specks 8 will be of all possible different sizes and shapes, and even color specks 8 smaller than 0.0001 $mm^2$ or larger than 0.5 $mm^2$ can be present, but the clear majority of all color specks 8 will be within the indicated range. In any case, the area of a color speck 8, averaged over all the color specks 8, will be between 0.0001 and approximately 0.5 $mm^2$, preferably in the range of 0.0025-0.3 $mm^2$.

It can be seen in FIG. 1 that one color speck 8 can be located behind another and thus be partially concealed. Because the specks come in all different sizes, and especially because color specks 8 with relatively small areas are present, a nearly gap-free coloration of the visible lateral surface area in the compressed state is obtained even when observed under a microscope.

FIG. 2 shows a view of the joint-sealing tape identical to that of FIG. 1, except that here the sealing tape is in the partially expanded functional state. This partially expanded functional state is usually in a range of 15-80%, and preferably of 25-60%, of the maximum expansion of the sealing tape. The compressed state shown in FIG. 1, conversely, corresponds to a compression of the sealing tape to 10-60%, and preferably to 15-50%, of its original thickness. The foam is always more highly compressed in the compressed state than it is in the partially expanded functional state.

It can be clearly seen that, as a result of the expansion, in the present case a partial expansion by about 40% versus the compressed state shown in FIG. 1, the pores in the foam have become larger than those present in the compressed state and thus the distances between the individual color specks 8 has increased. Nevertheless, when viewed with the naked eye, the perception of a continuous color surface remains. This is attributable to the fact that the human eye can no longer differentiate the individual color specks 8 from each other, because the gaps between the color specks 8 are so small that the human eye cannot resolve them. During expansion, the surface area of the foam increases correspondingly, so that regions of the sealing tape lying deeper down and thus color specks 8 lying deeper down now become visible and are able to contribute to the appearance of the surface area visible from the side. Under the microscope, it can be seen that the color specks 8 of various sizes, when viewed from the side, together constitute at least 60% of the overall visible surface area.

Because the cell webs 7 (FIG. 4) of the foam material also contribute to the overall visual impression, the base color of the foam must also be taken into account when determining how to obtain the desired color tone. Preferably, therefore, relatively light colors, e.g., light gray, will be preferred for the foam material. To prepare the substrate and to intensify the achieved colorizing action, the effect can also be improved by a preceding coloration step with a light base color (e.g., white), followed by coloring with the final desired hue.

Figure 5:
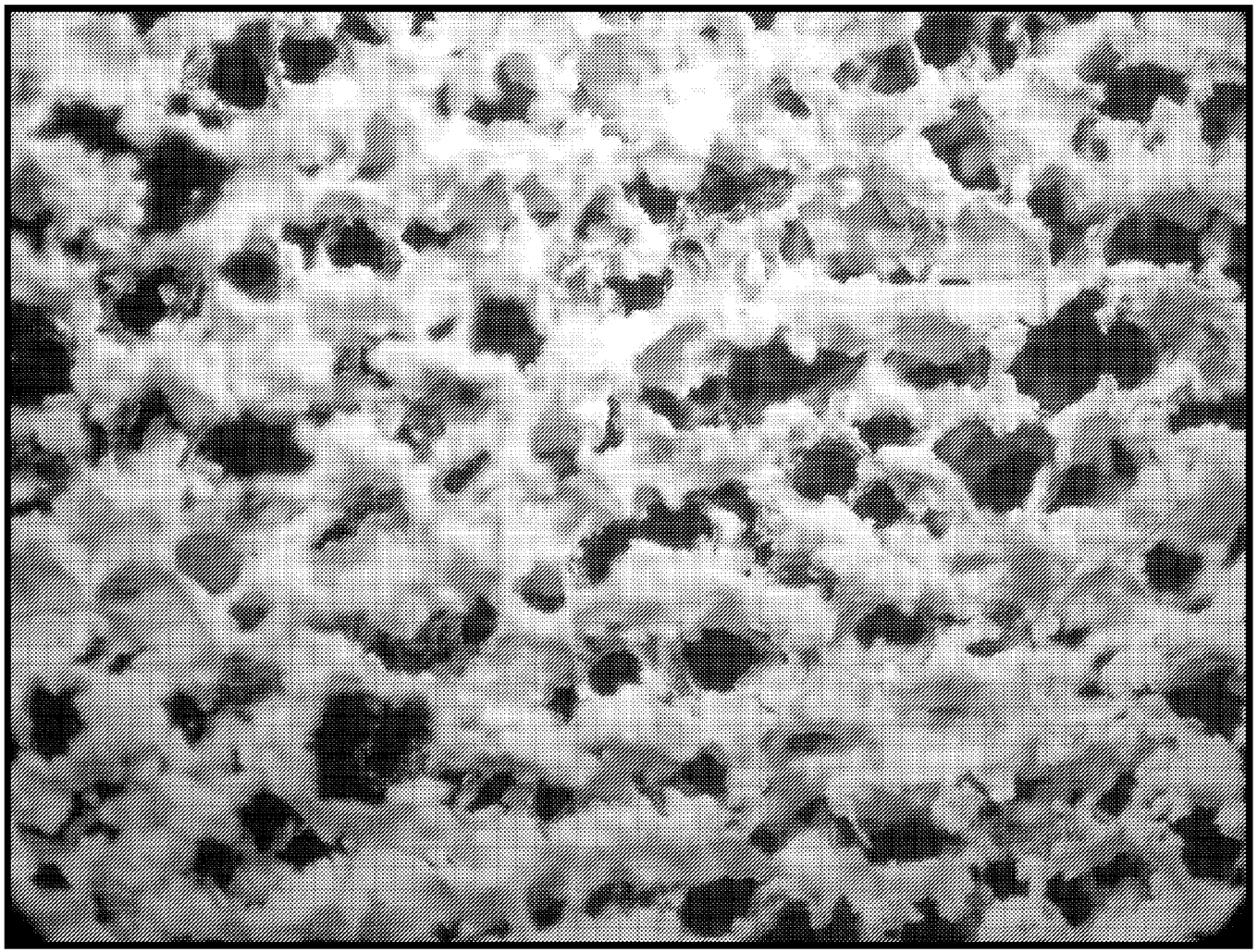
FIG. 5 is a microscopically magnified view of the colored lateral surface of the joint-sealing tape, in which the network of color specks can be seen.

As can be seen in the micrograph of an inventively colored lateral surface of a sealing tape in the recovered state in FIG. 5, the individual color specks 8 will, in practice, form a network of tight rows, creating in turn the impression of a large flat colored area. For this reason, therefore, and also because of the three-dimensional aspect of the structure, it will be difficult even under the microscope to distinguish objectively the individual, separate color specks 8. In fact, continuous flat color structures, possibly in the form of color strips several millimeters in length, can form in some cases along the cell webs 7 of the foam.

Aqueous acrylate dispersions, polyurethane dispersions, silicones, silicates, ethylene-vinyl acetates, polyvinyl acetates, waxes, linseed oils, or casein can be considered as binders to be integrated into the colorant. Because of the small size of the pigments or dyes, the amount of binder in the colorant does not have to be high. 10 wt. % based on the colorant will usually be sufficient to produce a permanent bond to the cell webs 7 of the foam material.

It is also conceivable that dyes or pigments can be caused to bond to the joint-sealing tape by the use of a solvent. The surface of the foam or preferably of the impregnation agent, which has already been deposited on the surface and dried, is very slightly dissolved. After the solvent has evaporated, the dye or pigment will therefore settle on the substrate and bond to surface of the tape without the need for a binder. Slightly polar, perhaps dipolar, solvents such as alcohols are preferably used for this purpose.

The compressed joint-sealing tape according to the invention is produced as follows. First, the foam material is produced in the conventional manner in wide (possibly impregnated) foam layers, which are wound up on wide master rolls. These master rolls together with the foam wound up on them are cut at the desired points to obtain narrow joint-sealing tape rolls 9 (see FIG. 3). On the roll, the sealing tape is present in the compressed state shown in FIG. 1. Preferably in this state, the lateral coloration is now carried out by dipping the minimum of one lateral surface 3, 4 of the sealing tape into the colorant or by spraying or spreading the colorant over the lateral surface. The penetration depth of the colorant is preferably a few millimeters. The application process, the consistency of the colorant, and the properties of the foam (e.g., pore size, tape thickness, degree of compression) are the parameters which will determine the coloration process. Then the sealing tape can be unwound from the tape roll 9 and used for its intended purpose. After the pressure keeping the tape compressed is released, the tape re-expands, preferably after a certain delay, to the partially expanded functional state shown in FIG. 2, which has the effect of sealing the construction joint.

In this way, a roll of joint-sealing tape of flexible, shape-recovering foam is created, which provides excellent results when sealing exterior joints and creates a superior aesthetic impression.

The invention claimed is:

1. A roll of joint-sealing tape for sealing a construction joint, the roll comprising a partially compressed sealing tape of flexible foam capable of recovery after compression having a top surface, a bottom surface and two lateral surfaces, the foam being saturated with an adhesive impregnate, which improves sealing properties of the foam and delays recovery of the foam after it has been compressed, wherein the bottom surface of the sealing tape is covered with a peel-off strip under which a layer of pressure-sensitive adhesive is arranged on the impregnated foam, wherein at least one of the two lateral surfaces is colored with a colorant such that the coloration on said one lateral surface in a partially expanded functional state equivalent to 25-60% of an original thickness of the sealing tape appears to the human eye as a continuous colored surface, whereas no coloration is provided in the central area between the lateral surfaces, wherein an edge area of at least one of the two lateral surfaces of the joint-sealing tape is uniformly colored with the colorant to a depth of up to a few millimeters by means of dipping, spraying, or spreading, and, in a microscopic side view, appears as a network of many differently sized color specks, most of which are connected to each other, wherein, in the partially expanded functional state of the sealing tape, all of the color specks together in the edge area of the lateral surface appear in a microscopic side view to constitute at least 60% of the overall visible surface area, and wherein, after compression, the sealing tape recovers its shape uniformly over the entire width of the sealing tape.

2. The roll of joint-sealing tape according to claim 1 wherein the average area of a color speck in the partially expanded functional state of the sealing tape is in the range of 0.0001-0.5 $mm^2$.

3. The roll of joint-sealing tape according to claim 2 wherein the average area of a color speck in the partially expanded functional state of the sealing tape is in the range of 0.0025-0.3 $mm^2$.

4. A process for producing a roll of joint-sealing tape for sealing a construction joint with the following steps:

providing a sealing tape of flexible foam which has a top surface, a bottom surface and two lateral surfaces, the foam being saturated with an adhesive impregnate, which improves sealing properties of the foam and delays recovery of the foam after it has been compressed, wherein the bottom surface of the sealing tape is covered with a peel-off strip under which a layer of pressure-sensitive adhesive is arranged on the impregnated foam;

partially compressing the foam; and coloring the edge area of at least one of the two lateral surfaces to a depth of up to a few millimeters by means of dipping, spraying, or spreading with a colorant, so that the coloration on the lateral surface in a partially expanded functional state equivalent to 25-60% of the original thickness of the sealing tape appears to the human eye as a continuous colored surface, whereas no coloration is provided in the central area between the lateral surfaces, wherein the coloration is carried out in such a way that the sealing tape, in a microscopic side view, appears as a network of a many differently sized color specks, most of which are connected to each other, and in that, in the partially compressed functional state of the sealing tape, all of the color specks together in the edge area of the lateral surface appear in a microscopic side view to constitute at least 60% of the overall visible surface area, wherein, after compression, the sealing tape recovers its shape uniformly over the entire width of the sealing tape.

5. The process according to claim 4 wherein the joint-sealing tape is compressed to 10-60% of its original thickness before it is colored.

6. The process according to claim 4 wherein the colorant and the coloration process are selected in such a way that the average area of a color speck in the partially compressed functional state of the sealing tape is in the range of 0.0001-0.5 $mm^2$.

7. The process according to claim 4 wherein the colorant contains, as binder, an acrylate dispersion, an ethylene-vinyl acetate, a polyvinyl acetate, a polyurethane, or a silicate.

8. The process according to claim 4 wherein the colorant contains, as binder, a paraffin-based wax, fat, or oil, or a silane or a silicone.

9. The process according to claim 4 wherein the colorant contains a solvent.

10. The process according to claim 4 wherein the colorant contains a fire retardant.

11. The process according to claim 4 wherein the colorant contains a substance for providing protection against UV radiation.

12. The process according to claim 4 wherein the joint-sealing tape is compressed to 15-50% of its original thickness before it is colored.

13. The process according to claim 4 wherein the colorant and the coloration process are selected in such a way that the average area of a color speck in the partially compressed functional state of the sealing tape is in the range of 0.0025-0.3 $mm^2$.

14. The process according to claim 4 wherein the colorant contains a dipolar solvent.

* * * * *

UNITED STATES PATENT AND TRADEMARK OFFICE

CERTIFICATE OF CORRECTION

PATENT NO. : 8,147,955 B2
APPLICATION NO. : 12/102043
DATED : April 3, 2012
INVENTOR(S) : Deiss It is certified that error appears in the above-identified patent and that said Letters Patent is hereby corrected as shown below:

Title page, item (75) Inventors: delete "Martin Dieb" and insert --Martin Deiss--.

Signed and Sealed this
Thirtieth Day of October, 2012

David J. Kappos

David J. Kappos
*Director of the United States Patent and Trademark Office*